US007040244B1

(12) United States Patent
Ferran

(10) Patent No.: US 7,040,244 B1
(45) Date of Patent: May 9, 2006

(54) WATERCRAFT HAVING PLURAL NARROW HULLS AND HAVING SUBMERGED PASSIVE FLOTATION DEVICES

(75) Inventor: Robert J. Ferran, San Diego, CA (US)

(73) Assignee: Ferran Electro-Craft, Inc., Sorrento Valley, CA (US)

( * ) Notice: Subject to any disclaimer, the term of this patent is extended or adjusted under 35 U.S.C. 154(b) by 0 days.

(21) Appl. No.: 10/908,217

(22) Filed: May 2, 2005

(51) Int. Cl.
*B63B 1/12* (2006.01)

(52) U.S. Cl. ..... 114/61.14; 114/61.13; 114/283

(58) Field of Classification Search ..... 114/61.1, 114/61.12, 61.13, 61.14, 283
See application file for complete search history.

(56) References Cited

U.S. PATENT DOCUMENTS

| | | | | |
|---|---|---|---|---|
| 1,757,174 | A * | 5/1930 | Douglas | 114/61.13 |
| 3,636,907 | A * | 1/1972 | Scarritt, Sr. | 114/283 |
| 3,739,410 | A | 6/1973 | Fortin | 9/2 A |
| 4,509,899 | A | 4/1985 | Frederick | 416/99 |
| 4,867,090 | A | 9/1989 | Hall et al. | 114/61 |
| 4,919,063 | A | 4/1990 | Hall et al. | 114/56 |
| 4,981,099 | A | 1/1991 | Holder | 114/274 |
| 5,117,774 | A | 6/1992 | English et al. | 114/66 |
| 5,140,924 | A | 8/1992 | Dixon | 114/61 |
| 5,178,085 | A | 1/1993 | Hsu | 114/61 |
| 5,237,947 | A | 8/1993 | Manning | 114/61 |
| 5,301,624 | A | 4/1994 | Hall et al. | 114/61 |
| H1315 | H | 6/1994 | Levine | |
| 5,505,153 | A | 4/1996 | Veazey | 114/61 |
| 5,988,088 | A | 11/1999 | Ishida et al. | 114/66 |
| 6,073,569 | A * | 6/2000 | Motsenbocker et al. | 114/61.1 |
| 6,152,791 | A | 11/2000 | Sinko et al. | 440/6 |
| 6,167,829 | B1 | 1/2001 | Lang | 114/278 |
| 6,189,477 | B1 | 2/2001 | Cody | 114/343 |
| 6,273,015 | B1 | 8/2001 | Motsenbocker et al. | 114/61.12 |
| 6,435,123 | B1 | 8/2002 | Odegard | 114/274 |
| 6,439,148 | B1 | 8/2002 | Lang | 114/278 |
| 6,532,884 | B1 | 3/2003 | Profitt et al. | 114/61.12 |
| 6,588,352 | B1 * | 7/2003 | Kay | 114/61.12 |
| 6,729,258 | B1 | 5/2004 | Fuglsang et al. | 114/61.1 |
| 6,877,450 | B1 | 4/2005 | Schmidt et al. | 114/61.15 |
| 2002/0023579 | A1 | 2/2002 | Profitt et al. | |

FOREIGN PATENT DOCUMENTS

GB 2 047 631 * 12/1980

OTHER PUBLICATIONS

"Swath Vessels," http://www.solarnavigator.net/s_w_a_t_h.htm, 2 pages.
Lockheed Martin, "Lockheed Martin's Advanced Hullform Technologies, Bridging the Gap," http://www.fleetweeksandiego.org/SeaSlice.pdf, 2 pages.

* cited by examiner

*Primary Examiner*—Sherman Basinger
(74) *Attorney, Agent, or Firm*—Jerry Turner Sewell

(57) ABSTRACT

A watercraft has at least two narrow hulls with a shallow draft and has one or more passive flotation devices that are entirely submerged. The hulls enclose the power trains for the watercraft and are accessible from the compartments of the watercraft. The passive flotation devices do not include a power train or any other equipment requiring access from the compartments of the watercraft. The narrow, shallow draft hulls have low friction drag and produce a small bow wave. Thus, the watercraft is able to be propelled rapidly, to be propelled for a greater distance, and to be propelled efficiently by the power provided by smaller motors and lighter energy sources.

1 Claim, 8 Drawing Sheets

WATERCRAFT HAVING PLURAL NARROW HULLS AND HAVING SUBMERGED PASSIVE FLOTATION DEVICES

BACKGROUND OF THE INVENTION

1. Field of the Invention

The embodiments of the invention disclosed herein relate to a pleasure watercraft having plural hulls with narrow surface wave-generating cross sections to reduce the friction drag and to reduce the forward bow wave, and having streamlined submerged flotation devices to provide buoyancy.

2. Description of the Related Art

An electrically powered pleasure watercraft is a desirable alternative to a watercraft powered by an internal combustion engine for many applications. For example, electrical motors are quiet, economical, and nonpolluting. Thus, an electrically powered watercraft may be used in places (e.g., small restricted waterways, such as private lakes) and at times (e.g., at night or early morning) when a watercraft with conventional fuel-burning engines cannot be used.

On the other hand, an electrically powered pleasure watercraft tends to be slower than a conventionally powered watercraft of the same size because of limitations on the size and weight of the electrical motors and storage batteries that can be installed in a small hull. Furthermore, unlike an electrically powered commercial watercraft or a military watercraft, which has a fuel-powered generator to provide current to charge the batteries or to operate the electrical motors directly, an electrically powered pleasure watercraft usually does not have an on-board generator to maintain the charge of the batteries. Thus, the range of the electrically powered watercraft is limited by the capacity of the batteries (e.g., the amount of charge that can be supplied to the batteries when the batteries are charged while the watercraft is docked).

The limited range of an electrically powered pleasure watercraft reduces the utility of the watercraft, particularly with respect to large waterways or recreational areas with limited docking and recharging facilities. For example, the batteries are quite heavy and difficult to install and remove. Thus, if an electrically powered watercraft depletes the energy in the batteries during a cruise, a potential rescuer cannot easily provide an emergency supply of "fuel" to enable the watercraft to return to shore to be recharged. Most likely, the watercraft must be towed to shore to be recharged.

Because of the combination of low speed and limited range, electrically powered pleasure watercraft are generally used for sightseeing and picnicking cruises in protected harbors and other small waterways. Such watercraft are generally not desirable for extended cruises of long duration or at significant distances from docking/recharging facilities. Thus, a need exists for an electrically powered watercraft with an extended cruise range.

SUMMARY OF THE INVENTION

A watercraft in accordance with aspects of embodiments of the present invention includes a common platform spanning at least two spaced-apart hulls (e.g., a catamaran (twin-hull) or a trimaran (three-hull) configuration). The common platform supports the compartments of the watercraft (e.g., a control room, one or more passenger compartments, cargo areas, and the like).

Unlike conventional multiple-hull watercraft, the illustrated watercraft does not rely on the hulls for flotation.

Rather, each hull encloses a power train for a respective propulsion device (e.g., a propeller or the stern drive of an inboard/outboard motor). The power train in each hull is advantageously driven by a plurality of electrical motors or by a composite electrical motor having multiple driving components (e.g., plural rotors, plural stators, or plural sets of rotors and stators), on a common shaft within the same enclosure. Each of the plural motors or each of the driving components of a composite motor is independently drivable so that the power applied can be varied and so that power can be disconnected from an inoperative motor or an inoperative component without disconnecting the other motors or components.

Because of the narrow cross sections, the hulls of the watercraft do not provide sufficient buoyancy to support the watercraft. The embodiments of the invention include at least a pair of cylindrical flotation devices that provide sufficient buoyancy to cause the hulls of the watercraft to float on the surface with a very shallow draft. The flotation devices are mounted to the bottom surfaces of the hull or are mounted to the bottom of the common platform between the two hulls. In either embodiment, the flotation devices are displaced below the hulls or below the bottom of the common platform by a plurality of interconnecting members (e.g., struts). The lengths of the interconnecting members are selected so that when each flotation device is entirely submerged in water, the common platform is supported above the surface of the water and the hulls are floating in the water with the propeller in the water. The interconnecting members have narrow cross sections and do not produce sufficient drag friction to significantly impede the movement of the watercraft or to generate a significant bow wave.

In addition to providing the support for the propeller, the two hulls provide additional buoyancy to cause the watercraft to be stable with respect to the water surface. Each hull has a narrow cross section and has a streamlined forward surface area in comparison to conventional hulls. Accordingly, the combination of the shallow draft, the narrow cross-section and the streamlined forward surface area reduces the friction drag of the hulls and reduces the bow waves generated by the hulls in comparison with the friction drag and the bow waves produced by conventional hulls that provide primary flotation.

No significant bow waves are generated by the two fully submerged flotation devices. Furthermore, the submerged flotation devices do not encounter the rough surface water. The forward portion of each flotation device is streamlined to further reduce the friction drag opposing the forward motion of the watercraft. The reduced friction drag and the insignificant bow wave reduce the energy required to propel the watercraft. As a result, the watercraft is advantageously powered by an electrical motor for longer distances and at greater speeds than a conventional electrically powered watercraft.

Another aspect in accordance with embodiments of the present invention is a watercraft having at least two narrow hulls with a shallow draft and having one or more passive flotation devices that are entirely submerged. The hulls enclose the power trains for the watercraft and are accessible from the compartments of the watercraft. The passive flotation devices do not include a power train or any other equipment requiring access from the compartments of the watercraft. Accordingly, the flotation devices are sealed and do not have any access locations that would impede the smooth flow of water as the flotation devices are moved through the water. The struts connecting the flotation devices to the watercraft are narrow and generate an insignificant bow wave.

BRIEF DESCRIPTIONS OF THE DRAWINGS

Embodiments in accordance with the present invention are described below in connection with the accompanying drawing figures in which.

DETAILED DESCRIPTION OF THE PREFERRED EMBODIMENTS

Figure 1:
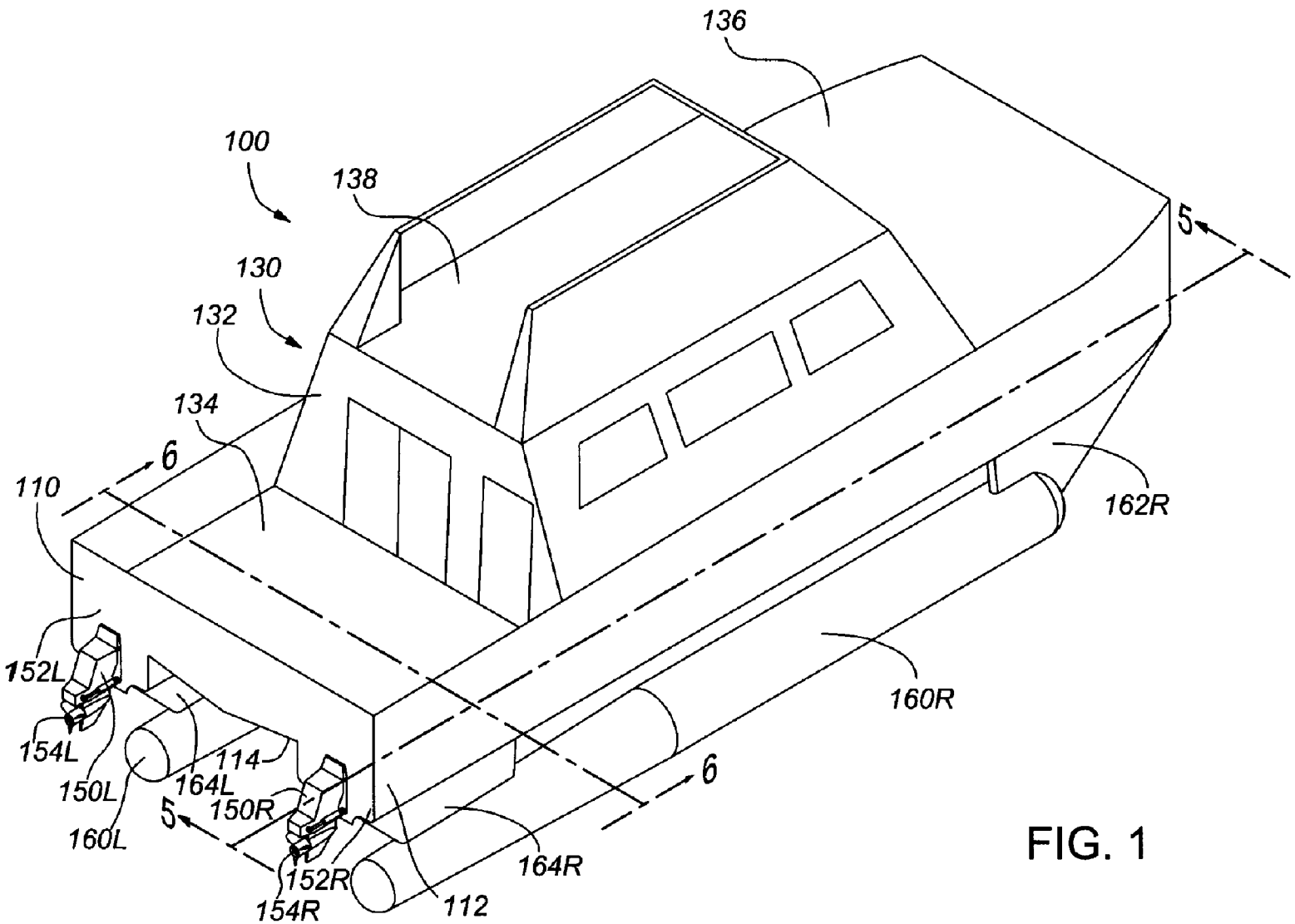
FIG. 1 illustrates a perspective view of an exemplary watercraft incorporating an embodiment of the present invention.

FIG. 1 illustrates a perspective view of an exemplary watercraft 100 incorporating an embodiment of the present invention. The watercraft 100 is illustrated as a pleasure watercraft having a first (port) hull 110 and a second (starboard hull) 112, which are interconnected by a common platform 114. The common platform 114 forms the base for the inhabitable environment 130 of the watercraft 100. For example, the inhabitable environment advantageously comprises a main cabin 132, an aft deck region 134, a forward deck region 136 and an upper control deck (bridge) 138. The cabin 132 may be a single large compartment or the cabin may be divided into multiple compartments (not shown). In the illustrated embodiment, the watercraft 100 has a length from bow to stern of approximately 14 meters and has a beam (width) across the stern of approximately 5 meters.

Although not shown in FIG. 1, the control deck 138 advantageously includes conventional steering and propulsion control devices along with navigation and communication equipment. In certain embodiments, the control devices and equipment are advantageously duplicated within the cabin 132 so that the watercraft may be operated from within the cabin during inclement weather.

As further illustrated in FIG. 1, a first stern drive unit 150L extends from the aft end 152L of the first hull 110 and drives a first propeller 154L. A second stern drive unit 150R extends from an aft end 152R of the second hull 112 and drives a second propeller 154R. The propellers 154L, 154R of the stern drive units 150L, 150R operate in conventional manners to produce propulsion to move the watercraft 100 in response to controls from the control deck 138 or the cabin 132. The two stern drive units 150L, 150R are pivotable with respect to the respective aft ends 152L, 152R in response to steering commands from the control deck 138 or the cabin 132 to change the direction of the propulsion to cause the watercraft 100 to turn. The stern drive units 150L, 150R also include conventional tilt mechanisms that are controllable to adjust the trim of the stern drive units 150L, 150R in a conventional manner.

As will be discussed in more detail below, the two stern drive units 150L, 150R differ from conventional stern drive units because the stern drive units 150L, 150R are powered by electrical motors (see FIG. 5 described below) rather than being provided by internal combustion engines. Although described herein with respect to the stern drive units 150L, 150R, it should be understood that embodiments of the invention may be incorporated into watercraft having propellers on fixed shafts and having separate rudders to provide directional control.

As illustrated in FIG. 1, the first hull 110 and the second hull 112 have narrow beams (e.g., narrow widths) and have shallow drafts. For example, the beam of each hull 110, 112 at the waterline of the watercraft 100 is approximately 50–80 centimeters. When the watercraft 100 is fully loaded with passengers and equipment, the draft of each hull 110, 112 is approximately 10 centimeters. The volume of water displaced by the two hulls 110, 112 with such a shallow draft is not sufficient to provide buoyancy for the watercraft 100 because of the weight of the watercraft. Instead, the primary sources of buoyancy for the watercraft 100 are a first (port) flotation device 160L and a second (starboard) flotation device 160R.

Each flotation device 160L, 160R is generally torpedo-shaped and extends approximately 1.5 meters below the respective hull 110, 112. Thus, the total draft of the watercraft is approximately 1.6 meters. As discussed in more detail in connection with FIGS. 4 and 5, forward portion of each flotation device 160L, 160R has a diameter of approximately 1 meter, and an aft portion of each flotation device tapers to a diameter of approximately 50 centimeters.

In the illustrated embodiment, the second flotation device 160R is coupled to the second hull 112 by a starboard forward interconnection member (strut) 162R and a starboard rear interconnection member (strut) 164R. Similarly, the first flotation device 160L is coupled to the first hull 110 by a port forward interconnection member 162L (see FIG. 3) and a port rear interconnection member 164L.

In the illustrated embodiment, the forward struts and the rear struts have vertical heights selected to position the upper surfaces of the forward portions of the flotation devices approximately 50 centimeters from the bottom surfaces of the hulls 110, 112. The flotation devices 160L, 160R have respective longitudinal axes that are parallel to the bottom surfaces of the hulls 110, 112 such that the forward sections of the flotation devices 160L, 160R are substantially parallel to the bottom surfaces. The vertical heights of the rear struts 164L, 164R are longer than the lengths of the forward struts 162L, 162R to accommodate the tapering diameters of the aft sections of the flotation devices 160L, 160R.

Figure 2:
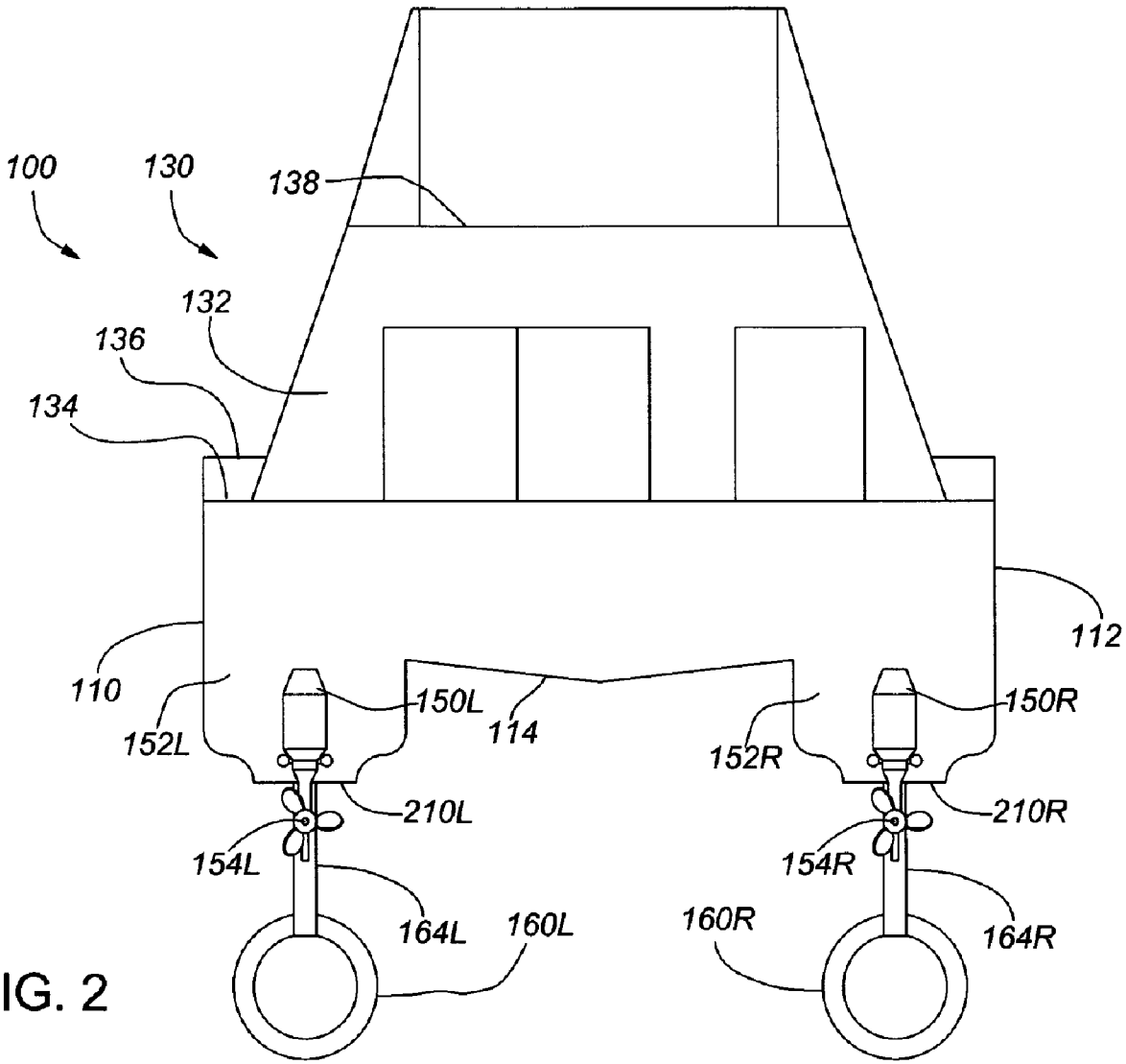
FIG. 2 illustrates a rear elevational view of the watercraft of FIG. 1.

FIG. 2 illustrates a rear elevational view of the watercraft of FIG. 1. In the illustrated embodiment, the port flotation device 160L is located directly beneath the port hull 110, and the starboard flotation device 160R is located directly beneath the starboard hull 112. As shown more clearly in FIG. 2, the rotational axes of the port propeller 154L and the starboard propeller 154R are positioned below a plane defined by a lower surface 210L of the port hull 110 and a lower surface 210R of the starboard hull 112.

Figure 3:
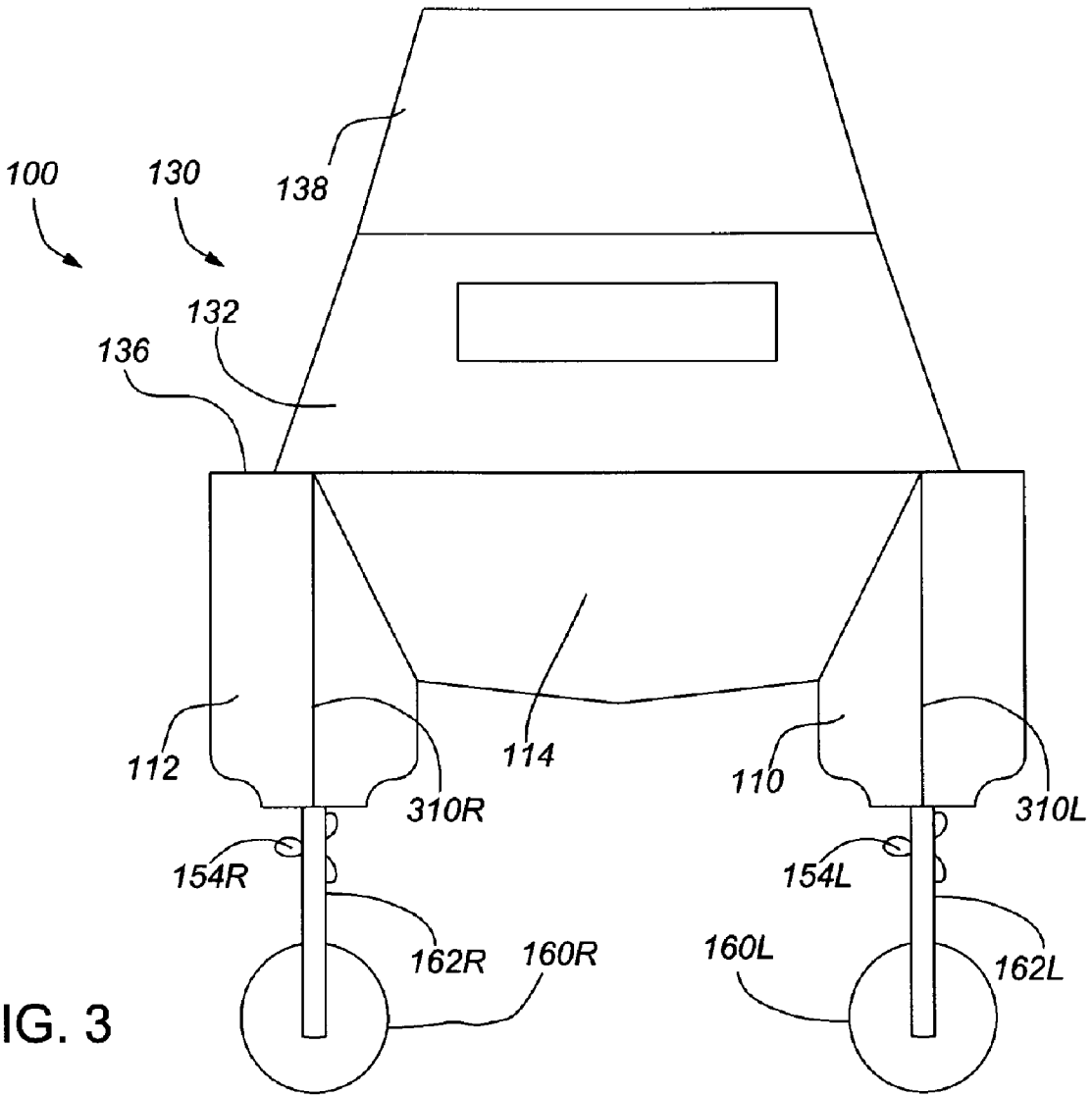
FIG. 3 illustrates a front elevation view of the watercraft of FIG. 1.

FIG. 3 illustrates a front elevational view of the watercraft 100 of FIG. 1. As shown in FIG. 3, each of the hulls 110, 112 tapers to a respective sharp leading edge 310L, 310R to reduce the bow waves of the shallow draft hulls. The bottom surface of the common platform 114 slopes upward between the forward portions of the hulls 110, 112 to support the forward deck 136.

In another embodiment (not shown), the flotation devices are advantageously coupled directly to the support platform 114, and the interconnection struts are located between the two hulls 110, 112. In the alternative embodiment, the two flotation devices are located symmetrically with respect to the bow-to-stern centerline of the watercraft 100.

Figure 4:
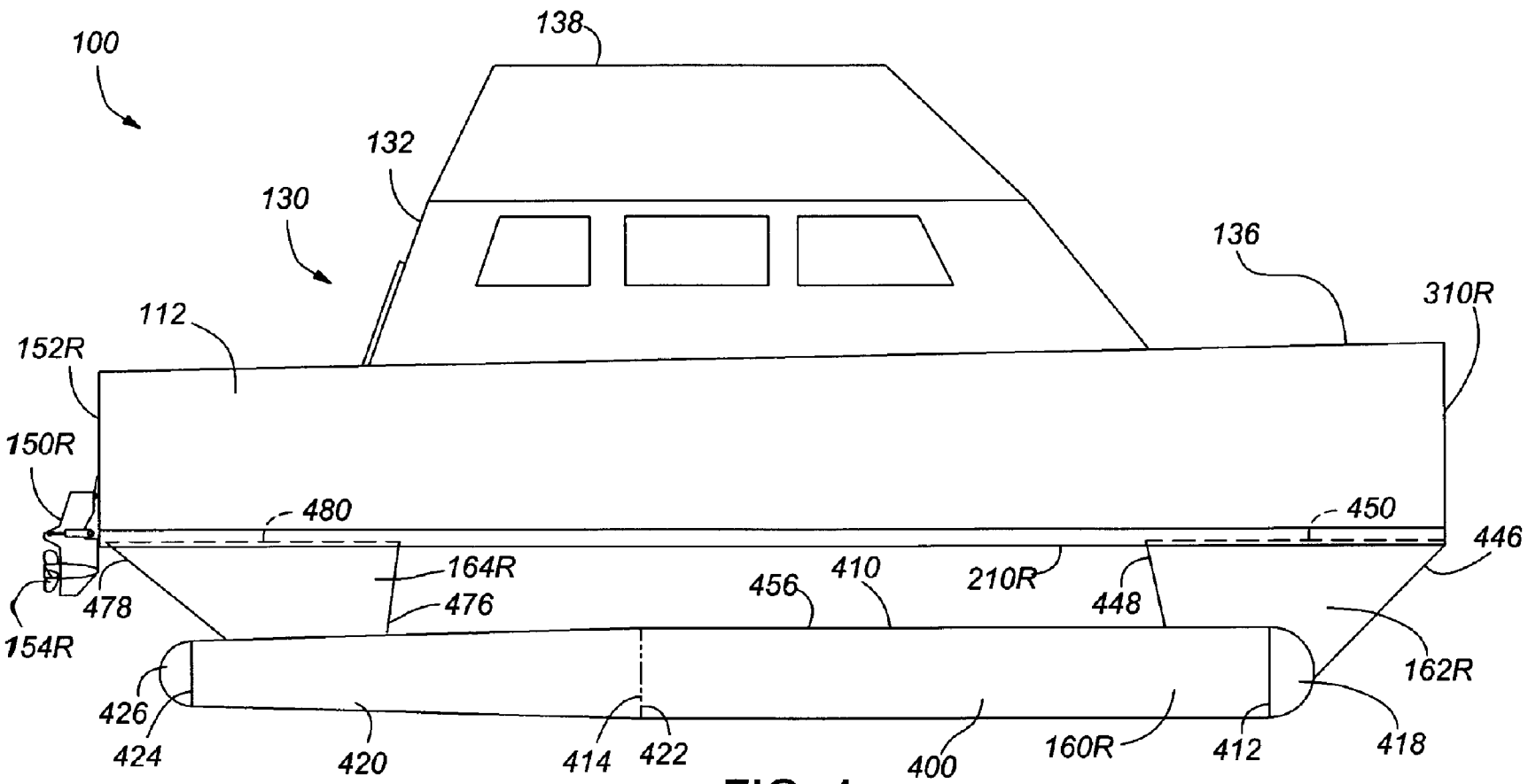
FIG. 4 illustrates a side elevational view of the starboard (right) side of the watercraft of FIG. 1.
Figure 5:
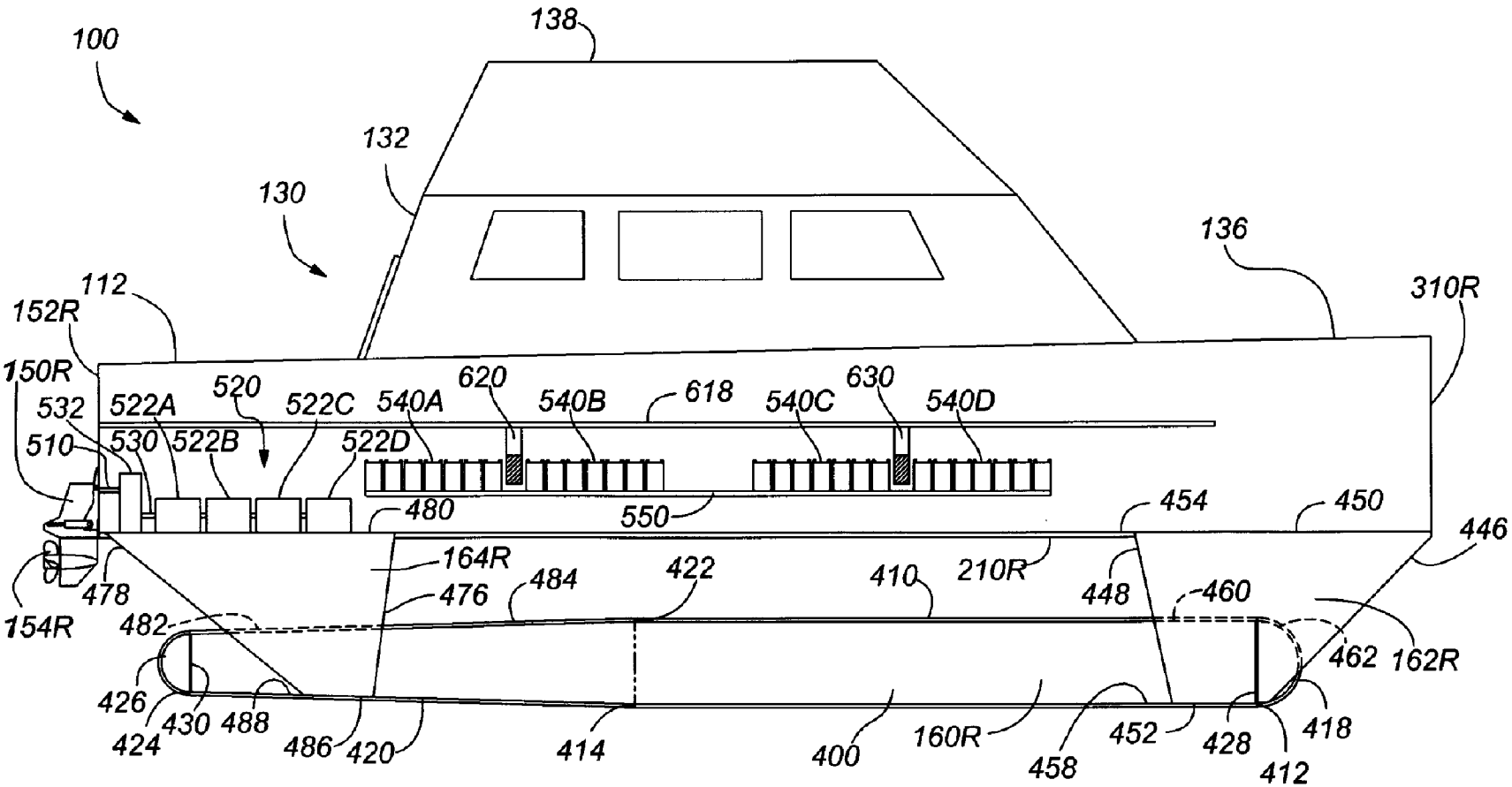
FIG. 5 illustrates a side elevational view in cross section of the watercraft of FIG. 1 taken along the lines 5—5 in FIG. 1.

FIG. 4 illustrates a side elevational view showing the starboard (right) side of the watercraft 100 of FIG. 1. FIG. 5 illustrates the side elevational view of FIG. 4 in a cross section taken along the lines 5—5 in FIG. 1 to show the interiors of the starboard passive flotation device 160R and the starboard hull 112. In particular, FIGS. 4 and 5 show the starboard passive flotation device 160R positioned beneath the bottom surface 210R of the starboard hull 112. The port passive flotation device 160L and the port hull 110 have similar construction and are not separately described herein.

As illustrated in FIGS. 4 and 5, the flotation device 160R comprises a substantially hollow cylinder 400. In the illustrated embodiment, the flotation device comprises a fiberglass composite having a thickness of approximately 1 centimeter. The flotation device 160R has an overall length of approximately 13 meters. The flotation device 160R includes a generally cylindrical main body portion 410 having a diameter of approximately 1 meter and having a length of approximately 7 meters. The main body portion 410 extends from a forward end 412 to an aft end 414 (represented by a phantom line in FIGS. 4 and 5). The forward end 412 of the main body portion 410 is covered with a generally hemispherical forward end cap 418, which is attached to the forward end 412 in a suitable manner for the material used to construct the flotation device 160R (e.g., by resin bonding techniques for the fiberglass composite material in the preferred embodiment). The attachment is continuous around the perimeter of the forward end 412 in order to provide a strong, watertight seal. The generally hemispherical shape of the forward end cap 418 reduces the drag friction of the flotation device 160R as the watercraft 100 moves forward in water.

The aft end 414 of the main body portion 410 is securely attached to the forward end 422 of a tapered body portion 420, which has a forward diameter that conforms to the diameter of the main body portion 410. The attachment between the aft end 414 of the main body portion 410 and the forward end 422 of the tapered body portion 420 is continuous and watertight, as discussed above. The tapered body portion 420 has a length of approximately 5 meters, and tapers gradually from the forward end 422 to an aft end 424. The diameter of the aft end 424 is approximately 50 centimeters. The aft end 422 is covered with a generally hemispherical end cap 426, which is secured by a suitable manner to form a continuous, watertight seal, as discussed above.

As shown in FIG. 5, the bow end 412 further includes a forward bulkhead 428 proximate to the forward end cap 418 and an aft bulkhead 430 proximate the aft end cap 426. The two bulkheads 428, 430 provide additional structural support for the flotation device 410. Preferably, additional bulkheads (not shown) are included to divide the flotation device 160R into a plurality of small watertight compartments. Thus, if the flotation device 160R is punctured, any water entering the flotation device will be confined to a single compartment.

As discussed above and as further shown in FIGS. 4 and 5, the starboard flotation device 160R is secured to the bottom of the starboard hull 112 by the forward starboard strut 162R and the aft starboard strut 164R. In the illustrated embodiment, the strut 162R and the strut 164R have trapezoidal shapes when viewed from the side of the watercraft 100. The struts 162R, 164R have thicknesses of approximately 10 centimeters. In a preferred embodiment, the struts 162R, 164R are hollow and are formed from a fiberglass and foam composite having a thickness of approximately 2 centimeters. In the hollow embodiments, the struts 162R, 164R are sealed so that the struts are watertight.

The strut 162R has a forward edge 446, an aft edge 448, an upper end 450 and a lower end 452 (see FIG. 5). The forward edge 446 is curved to reduce friction drag. The aft edge 448 is also curved in the preferred embodiment.

The forward edge 446 and the upper end 448 intersect at the bow 310R. The upper end 450 of the strut 162R is secured to the bottom surface 210R of the starboard hull 112 to provide a continuous, watertight seal. The upper end 450 is secured by suitable techniques for the selected materials of the strut 162R and the bottom surface 210R. For example, in a particularly preferred embodiment, the bottom surface 210R comprises a plate 454 of fiberglass, which has a thickness of approximately 2 centimeters. As shown in FIG. 5, the upper end 450 of the strut 162R advantageously passes through the plate 454 and is secured to the plate by resin bonding. In the illustrated embodiment, the upper end 450 has a length in a direction from the bow 310R towards the stern of approximately 2 meters.

In the illustrated embodiment, the forward edge 446 of the strut 162R forms an angle in a range of 35–45 degrees with respect to the bottom surface 210R. The forward edge 446 intersects the forward end cap 418 a short distance below the longitudinal center line of the flotation device 160R. The aft edge 448 forms an angle in a range of 80–90 degrees with respect to the bottom surface 210R. In the illustrated embodiment, the lower end of the aft edge 448 is slightly forward of the upper end of the aft edge. The aft edge 448 intersects the top surface 456 of the flotation device 160R. The angles and the lengths of the forward edge 446 and the trailing edge 448 are selected so that the top surface 456 of the main body portion 410 of the starboard flotation device 160R is spaced apart from the bottom surface 210R of the starboard hull 112 by approximately 50 centimeters.

As shown in FIG. 5, the lower end 452 of the strut 162R is enclosed within the flotation device 160R and is generally parallel to a lower inside surface 458 of the flotation device 160R. The strut 162R passes through an opening 460 in the top of the flotation device 160R and through an opening 462 in the end cap 418. (The openings are represented as phantom lines in FIG. 5.) The strut 162R is securely attached to the edges of openings 460, 462 by a continuous, watertight seal. In the preferred embodiment, the strut 162R is also attached to the forward bulkhead 428 to provide additional structural integrity.

In a similar manner, the aft starboard strut 164R has a forward edge 476 and a trailing edge 478. An upper end 480 of the strut 164R has a length along the bottom surface 210R of the starboard hull 112 of approximately 2 meters and is secured to the plate 454 of the bottom surface 210R in the manner described above for the forward strut 162R.

The forward edge 476 of the aft strut 164R forms an angle of approximately 80–90 degrees with respect to bottom surface 210R. In the illustrated embodiment, the lower end of the forward edge 476 is slightly astern of the upper end of the forward edge. The aft edge 478 forms an angle of approximately 40–50 degrees with respect to the bottom surface 210R.

The forward edge 476 and the trailing edge 478 of the strut 164R extend through an opening 482 (shown in phantom) in the upper surface 484 of the tapered body portion 420. As shown in FIG. 5, the forward edge 476 and the trailing edge 478 extend to a lower end 486, which is positioned proximate to an inside lower surface 488 of the tapered body portion 420. The strut 164R is secured to the edges of the opening 482 by a continuous, watertight seal. The lengths of the forward edge 476 and the trailing edge 478 between the bottom surface 210R of the starboard hull 112 and the upper surface 484 of the tapered body portion 420 are selected so that the longitudinal axis of the starboard flotation device 160R is maintained substantially parallel to the bottom surface 454. For example, in the illustrated embodiment, the forward edge 476 has a length of approximately 1.5 meters and the trailing edge 478 has a length of approximately 2 meters.

As illustrated in the drawing figures and as described above, the port flotation device 160L and the starboard flotation device 160R are entirely passive. In particular, no equipment or other components requiring access for maintenance or other service are enclosed in either flotation device. Thus, after the flotation devices are constructed and attached to the hulls 110, 112 in the manner described above, both flotation devices are advantageously permanently sealed. No access ports are included on either device, and the outer surfaces of the two devices are free of protrusions and other obstructions so that water flows around the two devices with very low drag. Furthermore, since no access to the flotation devices 160L, 160R from the hulls is required, the four struts 162L, 162R, 164L, 164R are quite thin (e.g., 10 centimeters) and do not generate a significant bow wave, even in an alternate embodiment (FIG. 7) where the flotation devices are connected directly to the common platform between the two hulls. Thus, the watercraft 100 is able to move through the water efficiently under the power of electrical motors described below.

As discussed above, the passive flotation devices 160L, 160R preferably include a plurality of bulkheads to create a plurality of watertight compartments to isolate any leakage to a single compartment. In a particularly advantageous embodiment, selected ones of the watertight compartments are used optionally to adjust the trim of the watercraft 100. For example, water or other liquid ballast can be selectively added to or selectively removed from one or more of a first compartment located proximate the forward starboard strut 162R, a second compartment located proximate the aft starboard strut 164R, a third compartment located proximate the forward port strut 162L, and a fourth compartment located proximate the aft port strut 164L. Suitable conduits (not shown) are routed through the hollow struts to interconnect the compartments with pumps (not shown) that are operated to add and remove the ballast liquid. An operator of the watercraft is able to adjust the weight of the liquid in each of the four compartments to change the center of gravity of the watercraft as desired. Because the conduits are routed through the struts, the conduits do not interfere with the smooth flow of water around the struts and the flotation devices.

As discussed above, the starboard stern drive unit 150R is mounted to the aft end 152R of the starboard hull 112. The orientation of the drive unit 150R (e.g., the steering and the trim) is controlled from the upper deck 138 or from the cabin 132 via conventional hydraulic or electrical control systems or other control mechanisms (not shown). The drive unit 150R receives power for turning the propeller 154R via an input shaft 510. In a conventional watercraft having a stern drive unit, the input shaft would be coupled to an output shaft of an internal combustion engine. In contrast, the input shaft 510 of the illustrated embodiment is coupled to an electrical drive assembly 520. In the illustrated embodiment, the electrical drive assembly 520 comprises a plurality (e.g., four) low voltage electrical motors 522A, 522B, 522C, 522D (hereinafter the motors 522). In certain embodiments, the motors 522 may be coupled directly to the input shaft 510. In the illustrated embodiment, the motors 522 are coupled to a power shaft 530, either directly as shown in FIG. 5 or via drive belts or another suitable coupling mechanism. The power shaft 530 is coupled to the input shaft 510 via a power transfer mechanism 532. The power transfer mechanism 532 advantageously includes drive belts or gears (not shown) that transfer the rotational power from the power shaft 530 to the input shaft 510 when electrical energy is applied to the motors 522. The transfer mechanism 532 advantageously eliminates any requirement to align the axis of rotation of the power shaft 530 with the axis of rotation of the input shaft 510. Thus, the positions of the motors 522 are selected to accommodate the structure of the hull 112 rather than having to position the power shaft 530 in direct alignment with the input shaft 510. The rotation of the motors 522 is electrically reversible to reverse the direction of the thrust provided by the propeller 154R. Alternatively, a conventional reversing mechanism within the stern drive unit 150R may be used to alter the direction of the thrust.

Each of the motors 522 is provided with electrical current from a respective bank of rechargeable batteries. In particular, the first motor 522A is supplied by a first battery bank 540A, the second motor 522B is supplied by a second battery bank 540B, the third motor 522C is supplied by a third battery bank 540C, and the fourth motor 522D is supplied by a fourth battery bank 540D. Each of the motors 522 is controlled by a respective motor controller (not shown). When more than one motor is operating, the motor controllers respond to a common control signal to control the rotational velocities of the respective motors so that the motors 522 operate at the same angular velocity (e.g., the same speed and direction). Since each of the motors 522 has an independent controller, any particular motor 522 may be turned off so that the inactive motor rotates freely as the power shaft 530 is rotated by the other motors. This feature advantageously allows the watercraft operator to disconnect one or more motors in order to conserve the energy stored in the associated battery bank and also allows the operator to disconnect a motor if the motor or the associated battery bank fails.

In other embodiments (not shown), a single electrical motor having multiple rotors and armatures in a common enclosure may be advantageously used instead of the plural electrical motors 522 in the illustrated embodiments. In either embodiment, using either plural electrical motors, or a single motor with multiple rotors and armatures, the power is advantageously supplied at a much lower voltage than if a single large motor were to be used. Among other advantages, the lower voltage is less hazardous in the potentially wet environment of a pleasure watercraft.

As shown in FIG. 5, each of the battery banks 540A. 540B, 540C, 540D in the starboard hull 112 comprises a plurality of storage batteries. For example, in one advantageous embodiment, each battery bank comprises 14 sealed rechargeable batteries (e.g., lead-acid batteries, lithium-ion batteries, or the like). Similar battery banks (not shown) are located in the port hull 110. Because of the weight of the batteries, the battery banks are preferably located symmetrically about the center of gravity of the watercraft 100 on a shelf 550.

Figure 6:
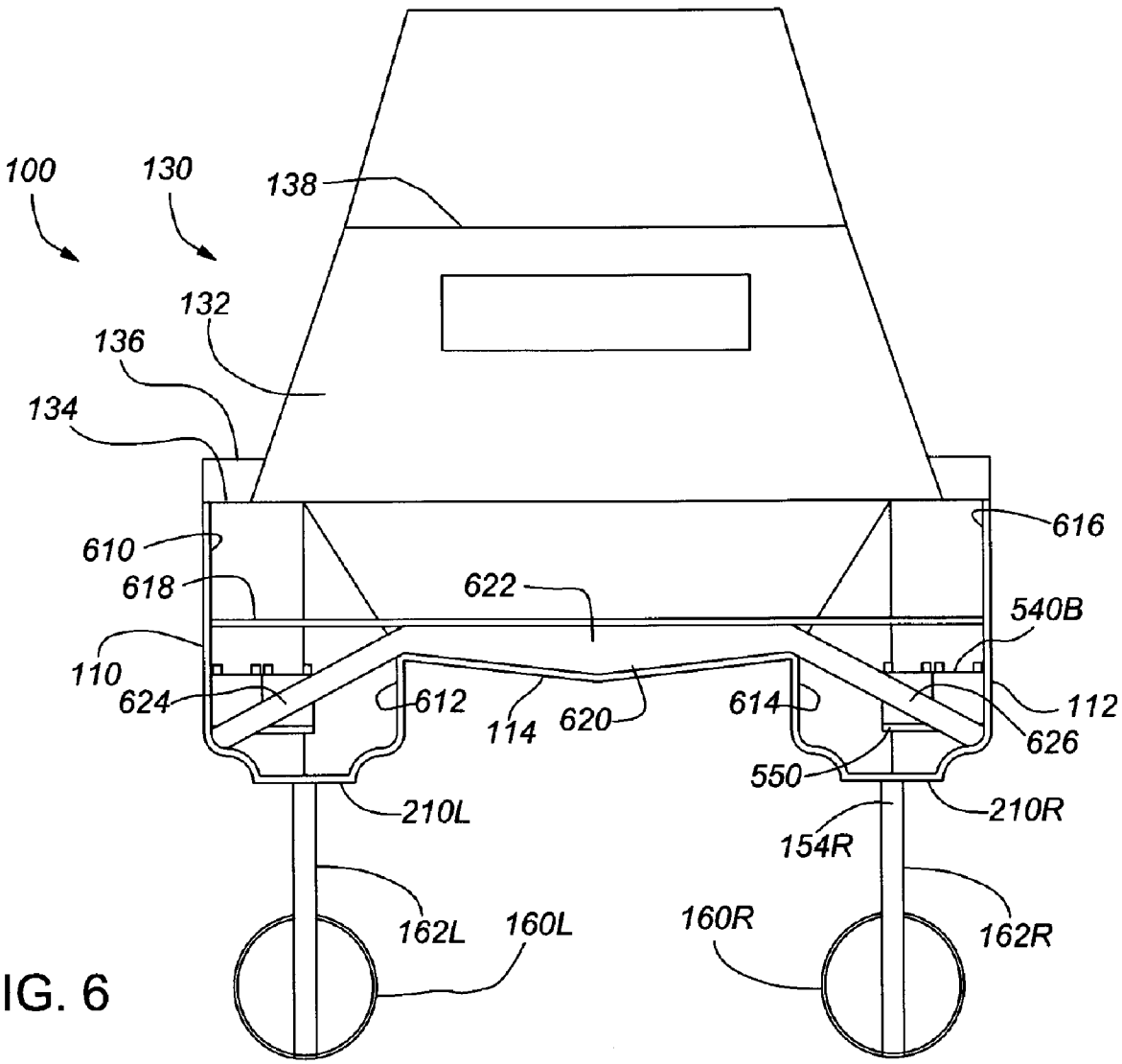
FIG. 6 illustrates a real elevational view in partial cross section of the watercraft of FIG. 1 taken along the lines 6—6 in FIG. 1.

FIG. 6 is a rear elevational view shown in a partial cross section taken along the lines 6—6 in FIG. 1. As shown in FIG. 6, the port hull 110 has a left side wall 610 and a right side wall 612. The starboard hull has a left side wall 614 and a right side wall 616. A common deck 618 extends from the left side wall 610 of the port hull 110 to the right side wall 616 of the starboard hull 112 and extends forward from the stern of the watercraft 100 to the forward end of the cabin 132. The motors 522 and the batteries 540 are located beneath the common deck 618. The common deck 618 is supported by a rear support beam 620 which has a generally horizontal middle portion 622 that extends from the top of the right side wall 612 of the port hull 110 to the top of the left side wall 614 of the starboard hull 112. A port angular portion 624 of the beam 620 extends downward and to the left from the left end of the middle portion 622 to a lower portion of the left side wall 610 of the port hull 110. A starboard angular portion 626 of the beam 620 extends downward and to the right from the right end of the middle portion 612 to a lower portion of the right side wall 616 of the starboard hull 112. The common deck 618 is also supported by a forward support beam 630 of similar construction at the location shown in FIG. 5. The hulls 110, 112, the common platform 114, and the common deck 618 are secured to the support beams 620, 630 to securely interconnect the elements of the watercraft 100. As shown in FIG. 5, the battery banks 540A, 540B, are located proximate the support beam 620 and the battery banks 540C, 540D are located proximate the support beam 630 so that the battery banks on the shelf 550 are supported by the support beams. The corresponding battery banks in the port hull 110 are also located proximate the support beams 620, 630.

Figure 7:
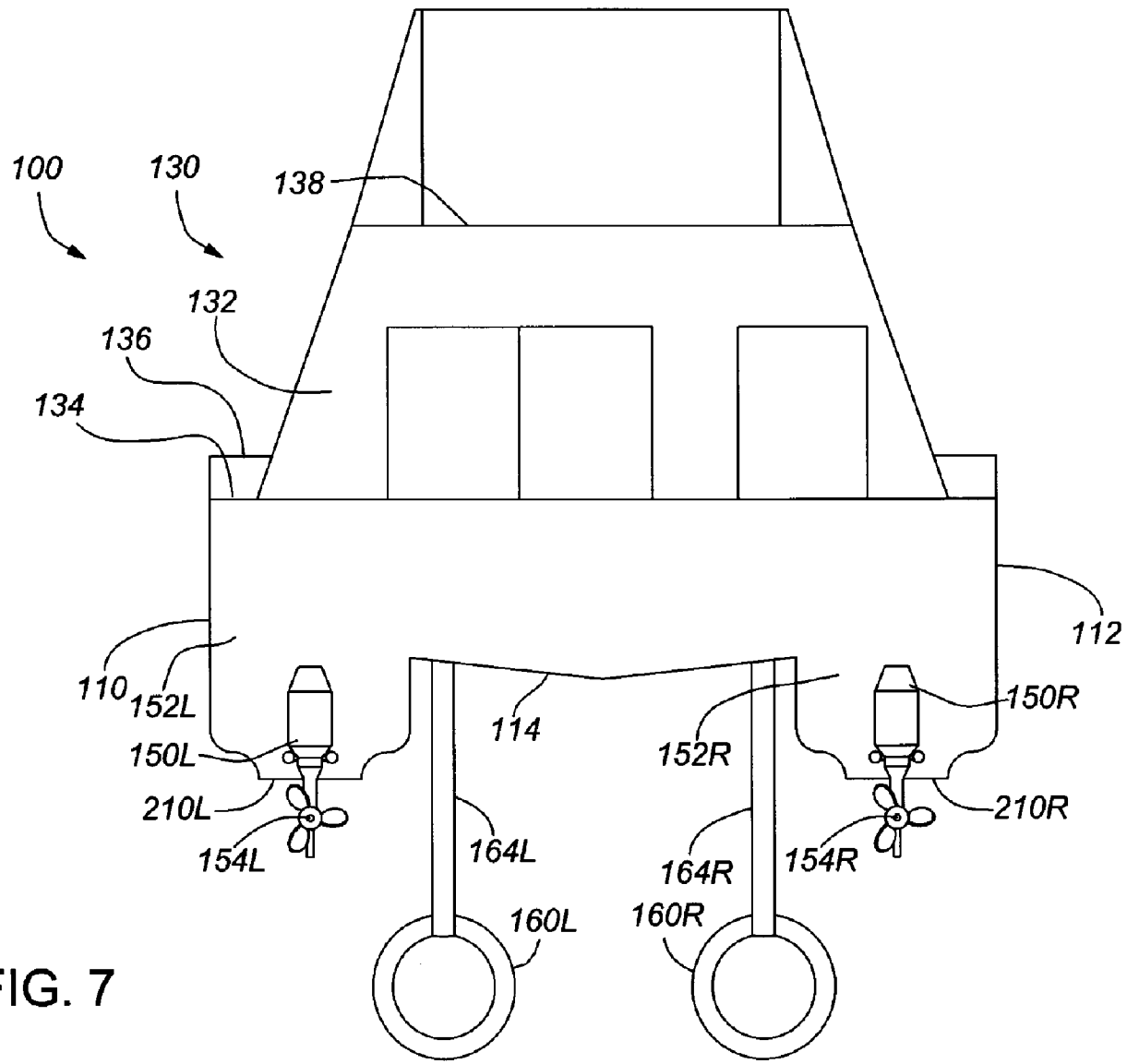
FIG. 7 illustrates a rear elevational view of another embodiment having passive flotation devices connected to common support platform.

FIG. 7 illustrates an embodiment wherein the aft port strut 164L is attached to the bottom of the common support platform 114 at a location to the right of the port hull 110, and wherein the aft starboard strut 164R is attached to the bottom of the common support platform 114 at a location to the left of the starboard hull 112. The forward struts 162L, 162R (not shown) are attached to the common support platform 114 at respective locations aligned with the rear struts 164L, 164R. As illustrated, the lengths of the struts are increased so that the port flotation device 160L and the starboard flotation device 160R are displaced below the bottom surfaces of the hulls 110, 112 by approximately the same distance as in the other embodiments (e.g., each flotation device extends approximately 1.5 meters below a plane defined by the bottom surfaces of the hulls). As further illustrated in FIG. 7, the two flotation devices 160L, 160R are located symmetrically with respect to the centerline of the watercraft 100. The longitudinal axis of the port flotation device 160L lies in a vertical plane located between the right side of the port hull 110 and a vertical plane passing through the fore-to-aft centerline of the watercraft 100. Similarly, the longitudinal axis of the starboard flotation device 160R lies in a vertical plane located between the left side of the starboard hull 112 and the centerline of the watercraft.

Figure 8:
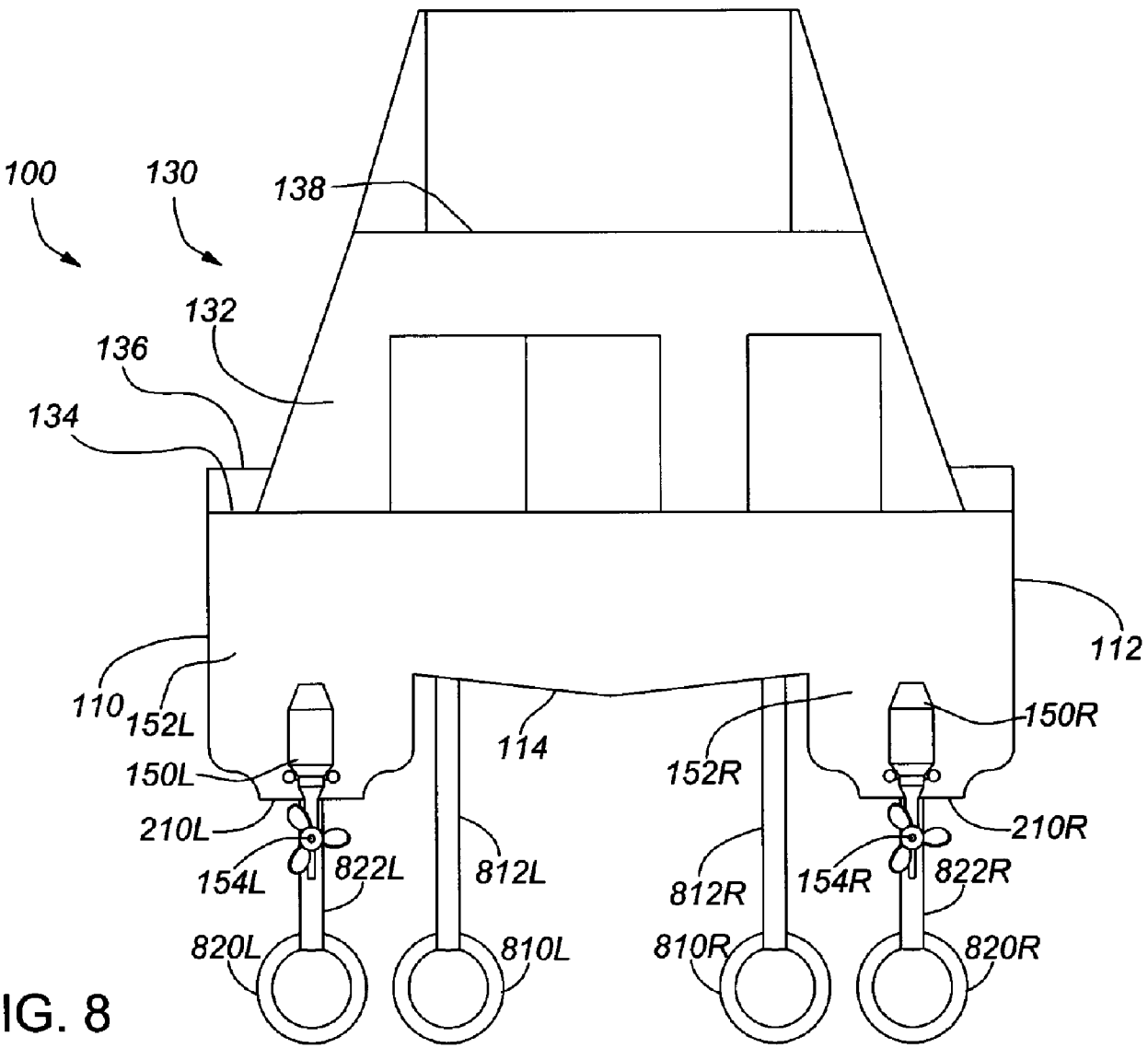
FIG. 8 illustrates a rear elevational view of another embodiment having passive flotation devices connected to the common support platform and to the bottom surfaces of the hulls.

FIG. 8 illustrates a rear elevational view of another embodiment having an inner port passive flotation device 810L connected to the common support platform 114 by a port inner strut 812L proximate to the port hull 110. An inner starboard passive flotation device 810R is connected to the common support platform 114 by a starboard inner strut 812R proximate to the starboard hull 112. The forward portions of the flotation devices 810L, 810R are connected to a forward portion of the common support platform 114 by respective forward struts (not shown). The two inner flotation devices 810L, 810R generally correspond to the two flotation devices in FIG. 7.

In FIG. 8, an outer port passive flotation device 820L is connected to the bottom surface 210L of the port hull 110 by an outer port strut 822L. An outer starboard passive flotation device 820R is connected to the bottom surface 210R of the starboard hull 112 by an outer starboard strut 822R. The forward portions of the flotation devices 820L, 820R are connected to a forward portion of the respective bottom surfaces 210L, 210R by respective forward struts (not shown). The two outer flotation devices 820L, 820R generally correspond to the two flotation devices in FIGS. 1–6.

In the embodiment of FIG. 8, the diameter of each of the flotation devices 810L, 810R, 820L, 820R is approximately 75 centimeters. Although the volume of each flotation device 810L, 810R, 820L, 820R is less than the volume of each flotation device 160L, 160R described above, the total volume of the four flotation devices in FIG. 8 is greater than the total volume of the two flotation devices in the embodiments of FIGS. 1–7. The smaller diameters of the flotation devices 810L, 810R, 820L, 820R reduce the depth of the lower surfaces of the flotation devices without raising the upper surfaces. Thus, the overall draft of the watercraft 100 is reduced with the flotation devices submerged below the surface of the water.

One skilled in art will appreciate that the foregoing embodiments are illustrative of the present invention. The present invention can be advantageously incorporated into alternative embodiments while remaining within the spirit and scope of the present invention, as defined by the appended claims.

The invention claimed is:

1. A watercraft comprising:

at least first and second hulls, each hull including at least one electrical motor and a propulsion device coupled to the electrical motor, each hull having a stern, a bow and a bottom surface extending in a forward direction between the stern and the bow, each of the hulls floating on a water surface during operation with a lower portion of each hull displacing water to provide buoyancy;

a structure supported by the first and second hulls;

a first passive flotation device positioned below and parallel to the first hull, the first passive flotation device mechanically coupled to the first hull by at least a first interconnection member, the first passive flotation device being entirely submerged during operation to provide additional buoyancy, the first passive flotation device comprising a sealed substantially hollow body, the first passive flotation device having no equipment within the body and having no access ports on the body; and a second passive flotation device positioned below and parallel to the second hull, the second passive flotation device mechanically coupled to the second hull by at least a second interconnection member, the second passive flotation device being entirely submerged during operation to provide additional buoyancy, the second passive flotation device comprising a sealed substantially hollow body, the second passive flotation device having no equipment within the body and having no access ports on the body.

* * * * *